US009596547B2

(12) United States Patent
Zhang

(10) Patent No.: US 9,596,547 B2
(45) Date of Patent: Mar. 14, 2017

(54) MEMS MICROPHONE WITH SPRING SUSPENDED BACKPLATE

(71) Applicant: Invensense, Inc., San Jose, CA (US)

(72) Inventor: Xin Zhang, Acton, MA (US)

(73) Assignee: INVENSENSE, INC., San Jose, CA (US)

( * ) Notice: Subject to any disclaimer, the term of this patent is extended or adjusted under 35 U.S.C. 154(b) by 33 days.

(21) Appl. No.: 14/656,662

(22) Filed: Mar. 12, 2015

(65) Prior Publication Data

US 2015/0195658 A1 Jul. 9, 2015

Related U.S. Application Data

(63) Continuation of application No. 13/719,466, filed on Dec. 19, 2012, now Pat. No. 9,002,039, which is a continuation of application No. 12/774,263, filed on May 5, 2010, now Pat. No. 8,363,860, which is a continuation-in-part of application No. 12/411,768, filed on Mar. 26, 2009, now Pat. No. 8,103,027.

(51) Int. Cl.

| | |
|---|---|
| ***H04R 25/00*** | (2006.01) |
| ***H04R 17/02*** | (2006.01) |
| ***H04R 1/22*** | (2006.01) |
| ***H04R 19/00*** | (2006.01) |
| ***H04R 19/04*** | (2006.01) |
| ***H04R 31/00*** | (2006.01) |

(52) U.S. Cl.

CPC ..... *H04R 17/02* (2013.01); *H04R 1/222* (2013.01); *H04R 19/005* (2013.01); *H04R 19/04* (2013.01); *H04R 31/00* (2013.01); *H04R 31/006* (2013.01); *H04R 2499/11* (2013.01); *Y10T 29/49005* (2015.01)

(58) Field of Classification Search

CPC ..... H04R 19/016; H04R 2201/003; B81B 2201/0235

See application file for complete search history.

(56) References Cited

U.S. PATENT DOCUMENTS

| | | | | |
|---|---|---|---|---|
| 4,776,019 | A * | 10/1988 | Miyatake | G01D 5/2417 181/158 |
| 5,408,731 | A | 4/1995 | Berggvist et al. | |
| 6,535,460 | B2 | 3/2003 | Loeppert et al. | |
| 8,130,979 | B2 * | 3/2012 | Harney | H04M 1/035 381/113 |
| 8,363,860 | B2 * | 1/2013 | Zhang | H04R 1/222 381/175 |
| 8,948,419 | B2 * | 2/2015 | Zhang | H04R 1/222 381/174 |
| 2008/0304681 | A1 * | 12/2008 | Langlois | H04R 1/222 381/174 |
| 2012/0033832 | A1 * | 2/2012 | van Lippen | B81C 1/00182 381/111 |

* cited by examiner

*Primary Examiner* — Ryan Robinson

(74) *Attorney, Agent, or Firm* — Maryam Imam; IPxLaw Group LLP

(57) ABSTRACT

A MEMS microphone has a base, a backplate, and a backplate spring suspending the backplate from the base. The microphone also has a diaphragm forming a variable capacitor with the backplate.

14 Claims, 15 Drawing Sheets

MEMS MICROPHONE WITH SPRING SUSPENDED BACKPLATE

PRIORITY

This patent application is a continuation of U.S. patent application Ser. No. 13/719,466, filed on Dec. 19, 2012, by Xin Zhang, and entitled, "MEMS Microphone with Spring Suspended Backplate", which is a continuation of U.S. patent application Ser. No. 12/774,263, filed on May 5, 2010, by Xin Zhang, and entitled, "MEMS MICROPHONE WITH SPRING SUSPENDED BACKPLATE," which is a continuation-in-part of U.S. patent application Ser. No. 12/411,768, filed on Mar. 26, 2009, by Xin Zhang, et al., and entitled, "MICROPHONE WITH REDUCED PARASITIC CAPACITANCE", which claims priority to U.S. provisional patent application No. 61/175,997, filed on May 6, 2009, by Xin Zhang, and entitled, "MEMS MICROPHONE WITH SPRING SUSPENDING BACKPLATE," the entire contents of which are hereby incorporated by reference herein, for all purposes.

FIELD OF THE INVENTION

The invention generally relates to MEMS microphones and, more particularly, the invention relates to improving performance of MEMS microphones.

BACKGROUND OF THE INVENTION

The core of a conventional MEMS condenser microphone is a variable capacitor, which commonly is formed from a static, unmovable substrate/backplate and an opposed movable diaphragm. In operation, audio signals strike the movable diaphragm, causing it to vibrate, thus varying the distance between the diaphragm and the backplate. This varying distance changes the variable capacitance, consequently producing an electrical signal that is directly related to the incident audio signal.

The backplate often has an unintended curvature caused from intrinsic stresses of the fabrication, assembly, and packaging processes. Undesirably, this curvature can create significant sensitivity variations in a MEMS microphone.

SUMMARY OF THE INVENTION

In accordance with one embodiment of the invention, a MEMS microphone has a base, a backplate with a plurality of apertures, and a backplate spring suspending the backplate from the base. The microphone also has a diaphragm forming a variable capacitor with the backplate.

The backplate spring may be formed in a variety of ways. For example, the backplate spring have a serpentine shape, or be substantially solid and circumscribe the backplate (e.g., like a drum). In the latter example, the backplate spring may have a thickness that is much less than the thickness of the backplate. Moreover, the backplate spring may have at least one tether, such as a solid tether or one that has at least one opening.

In some embodiments, the diaphragm and backplate may form a first space, while the backplate and another portion of the base may form a second space. The backplate separates these two spaces (i.e., the spaces are voids with no material). The second space may be an open space (e.g., a front volume).

The microphone also may have a diaphragm spring suspending the diaphragm from the base. The diaphragm spring may have a first spring constant, while the backplate spring has a second spring constant that is at least ten times larger than the first spring constant. For example, the backplate spring may have a spring constant that is high enough to cause the backplate to remain substantially stationary upon receipt of audio signals having amplitudes on the order of magnitude of the human speaking voice.

In accordance with another embodiment, a MEMS microphone has 1) a backplate with a backplate edge and a plurality of apertures, and 2) a diaphragm that forms a variable capacitor with an active sensing area of the backplate, and 3) a base supporting the backplate. Radially outward of the plurality of apertures, the backplate edge and base form a trench that effectively defines the noted active sensing area of the backplate. The microphone also has a backplate spring suspending the backplate from the base. The spring also at least in part forms the trench and addresses stress issues.

The backplate spring preferably permits movement of the backplate relative to the base upon application of torsional force sufficient to overcome the force of the backplate spring.

In accordance with other embodiments, a method of reducing stress on a MEMS microphone backplate provides a base that supports a diaphragm, and forms a variable capacitor by spacing a backplate from the diaphragm. The backplate is connected to the base with at least one spring configured to reduce stress on the backplate.

The method may apply an incident audio signal of a spoken human voice against the backplate and diaphragm while the base remains substantially immovable. In that case and in some embodiments, the backplate remains substantially immovable upon receipt of the audio signal. Some embodiments connect the backplate to the base with no more than one spring, and form a trench around at least a portion of the diaphragm.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a MEMS microphone has springs that suspend its backplate. Accordingly, the backplate should be compliant enough to effectively mitigate unintended curvature caused by normal fabrication, assembly and packaging stresses. This is contrary to prior art known by the inventor, which requires the opposite—completely static and immovable backplates to prevent signal degradation. The inventor thus discovered that, unlike the conventional wisdom, forming a backplate that is movable to some extent can improve, rather than degrade, microphone performance. Details of illustrative embodiments are discussed below.

Figure 1:
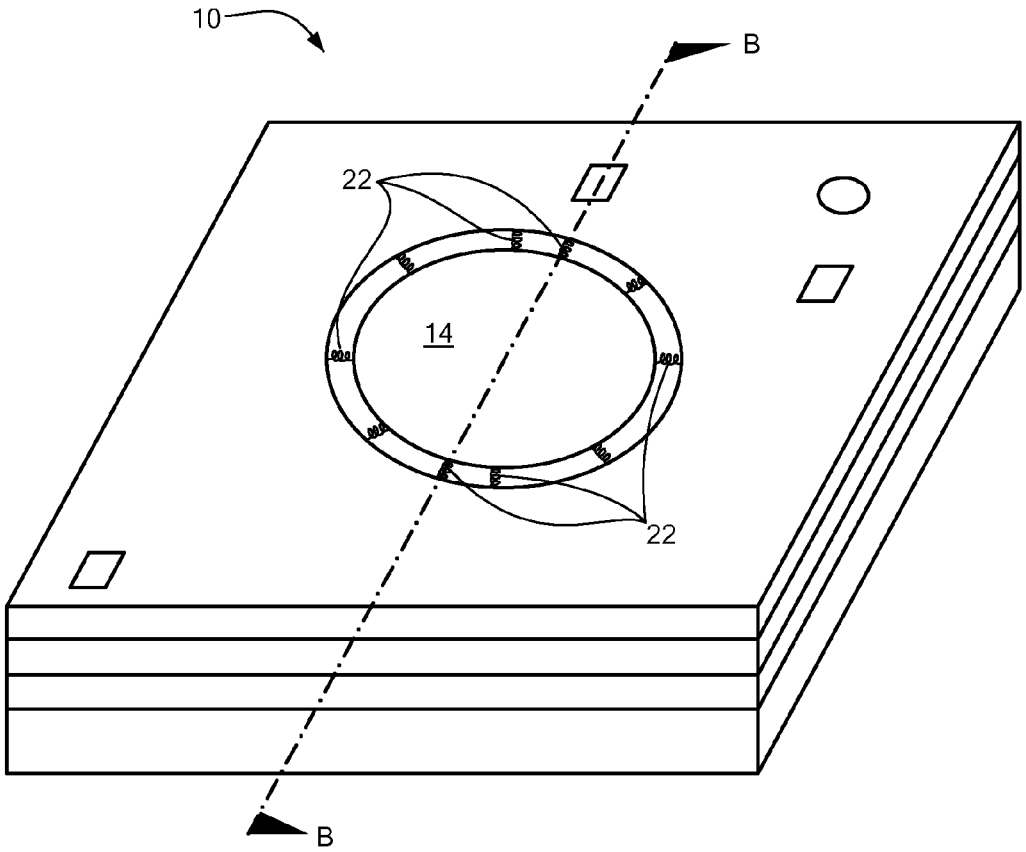
FIG. 1 schematically shows a top, perspective view of a MEMS microphone that may be configured according to illustrative embodiments of the present invention.
Figure 2:
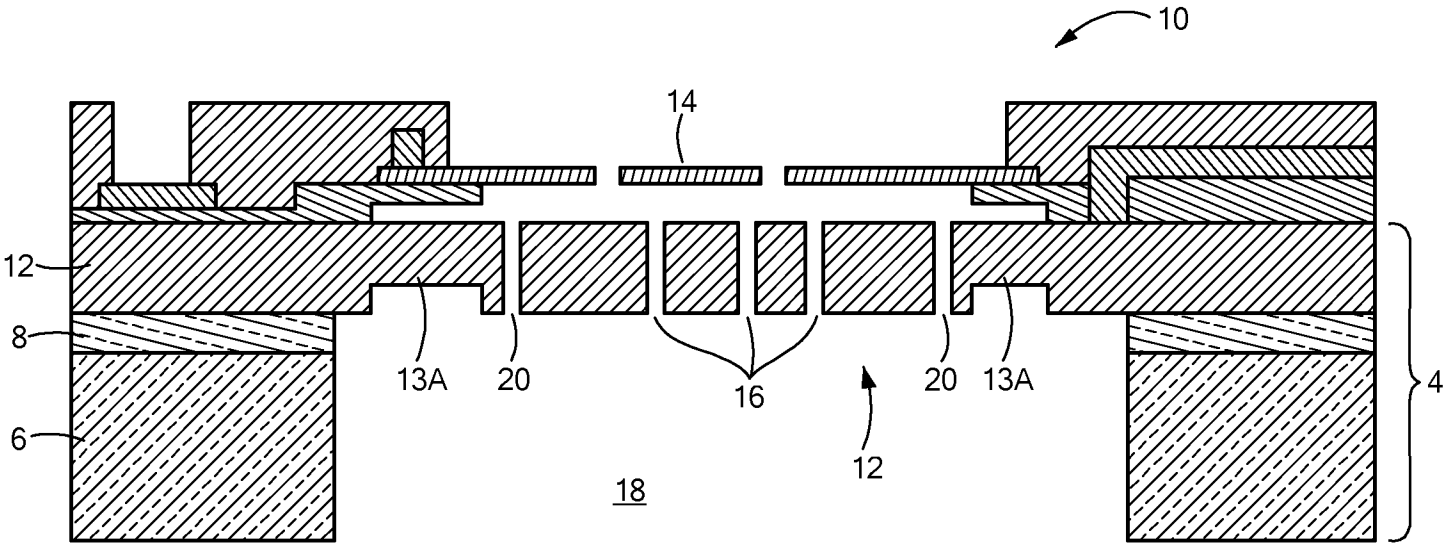
FIG. 2 schematically shows a cross sectional view of the MEMS microphone shown in FIG. 1 across line B-B.

FIG. 1 schematically shows a top, perspective view of an unpackaged microelectromechanical system (MEMS) microphone 10 (also referred to as a "microphone chip") that may be fabricated according to illustrative embodiments of the invention. FIG. 2 schematically shows a cross-sectional view of the microphone 10 of FIG. 1 across line B-B. These figures are discussed simply to detail some exemplary components that may make up a microphone produced in accordance with various embodiments.

As shown in FIG. 2, the microphone chip 10 has a chip base/substrate 4, one portion of which supports a suspended backplate 12. The microphone 10 also includes a flexible diaphragm 14 that is movable relative to the backplate 12. The backplate 12 and diaphragm 14 together form a variable capacitor. In illustrative embodiments, the backplate 12 is formed from single crystal silicon (e.g., a part of a silicon-on-insulator wafer), while the diaphragm 14 is formed from deposited polysilicon. In other embodiments, however, the backplate 12 and diaphragm 14 may be formed from different materials.

In the embodiment shown in FIG. 2, the substrate 4 includes the backplate 12 and other structures, such as the bottom wafer 6 and buried oxide layer 8 of an SOI wafer. A portion of the substrate 4 also forms a backside cavity 18 extending from the bottom of the substrate 4 to the bottom of the backplate 12. To facilitate operation, the backplate 12 has a plurality of through-holes 16 that lead to the backside cavity 18.

It should be noted that various embodiments are sometimes described herein using words of orientation such as "top," "bottom," or "side." These and similar terms are merely employed for convenience and typically refer to the perspective of the drawings. For example, the substrate 4 is below the diaphragm 14 from the perspective of FIG. 2. However, the substrate 4 may be in some other orientation relative to the diaphragm 14 depending on the orientation of the MEMS microphone 10. Thus, in the present discussion, perspective is based on the orientation of the drawings of the MEMS microphone 10.

In operation, audio signals strike the diaphragm 14, causing it to vibrate, thus varying the distance between the diaphragm 14 and the backplate 12 to produce a changing capacitance. Such audio signals may contact the microphone 10 from any direction. For example, the audio signals may travel upward, first through the backplate 12, and then partially through and against the diaphragm 14. In other embodiments, the audio signals may travel in the opposite direction.

Conventional on-chip or off-chip circuitry (not shown) converts this changing capacitance into electrical signals that can be further processed. This circuitry may be secured within the same package as the microphone 10 (e.g., on another chip within the same package), to the same substrate 4, or within another package. It should be noted that discussion of the specific microphone 10 shown in FIGS. 1 and 2 is for illustrative purposes only. Other microphone configurations thus may be used with illustrative embodiments of the invention.

Figure 3:
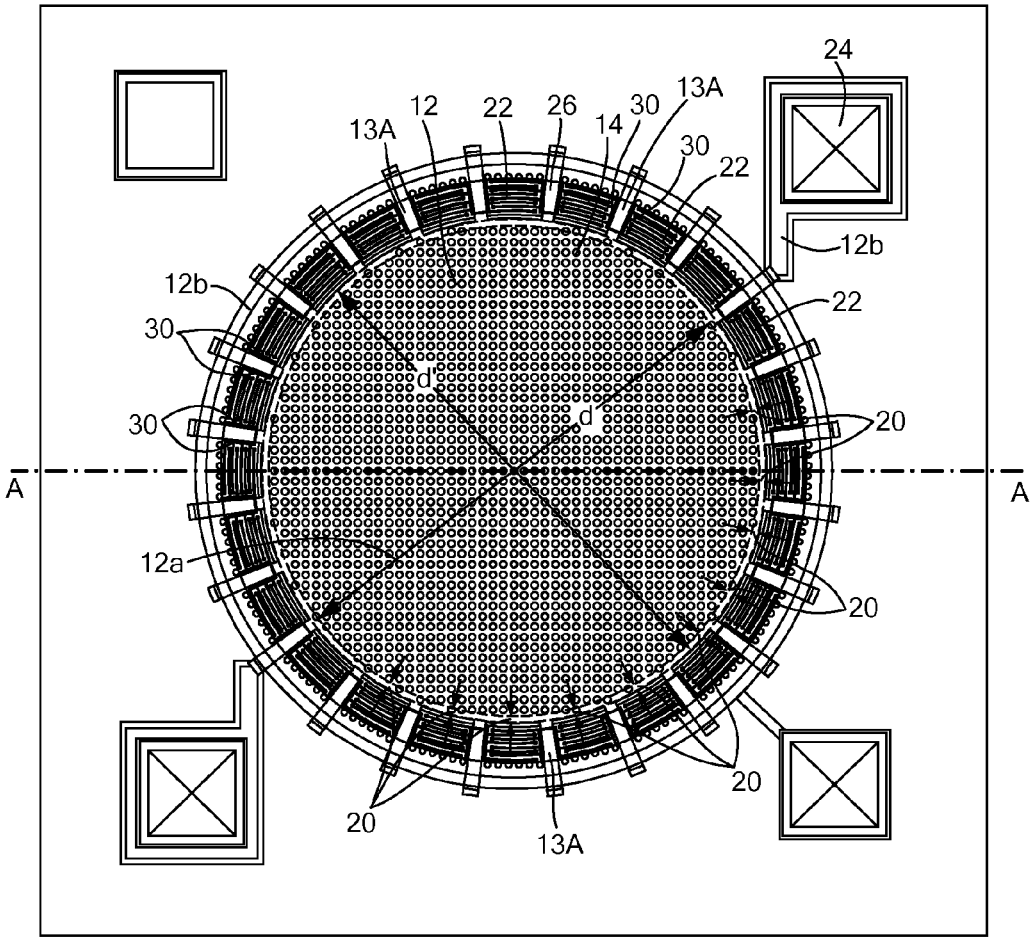
FIG. 3 schematically shows a top view of a MEMS microphone with a backplate having trenches and backplate springs according to illustrative embodiments of the present invention.

FIGS. 3-6 schematically show two microphone configurations having a backplate 12 configured according to illustrative embodiments of the present invention. Specifically, FIGS. 3 and 4A show a top view of one embodiment of a MEMS microphone 10 with a diaphragm 14 supported by diaphragm springs 22, and a backplate 12 having backplate springs 13A (also referred to as "tethers" and also shown in FIG. 2) that support the backplate on the base 4. In illustrative embodiments, the backplate springs 13A are fabricated so that he backplate 12 remains substantially unaffected upon receipt of an anticipated incident audio signal of normal intensity. For example, if the entire microphone is stationary, an audio signal, such as a human voice, incident upon the backplate 12 normally will not cause the backplate to appreciably move. Instead, if the backplate 12 moves at all, such negligible movement should not have an audibly noticeable impact on the resulting audio signal.

To that end, each backplate spring 13A should have a spring constant that is much greater than that of the springs 22 supporting the diaphragm 14. For example, the spring constant of the backplate springs 13A may be 10 to 100 times greater than that of the diaphragm springs 22. Alternatively, the collective spring constant of the backplate springs 13A should be much greater than the collective spring constant for the diaphragm springs 22.

Figure 4A:
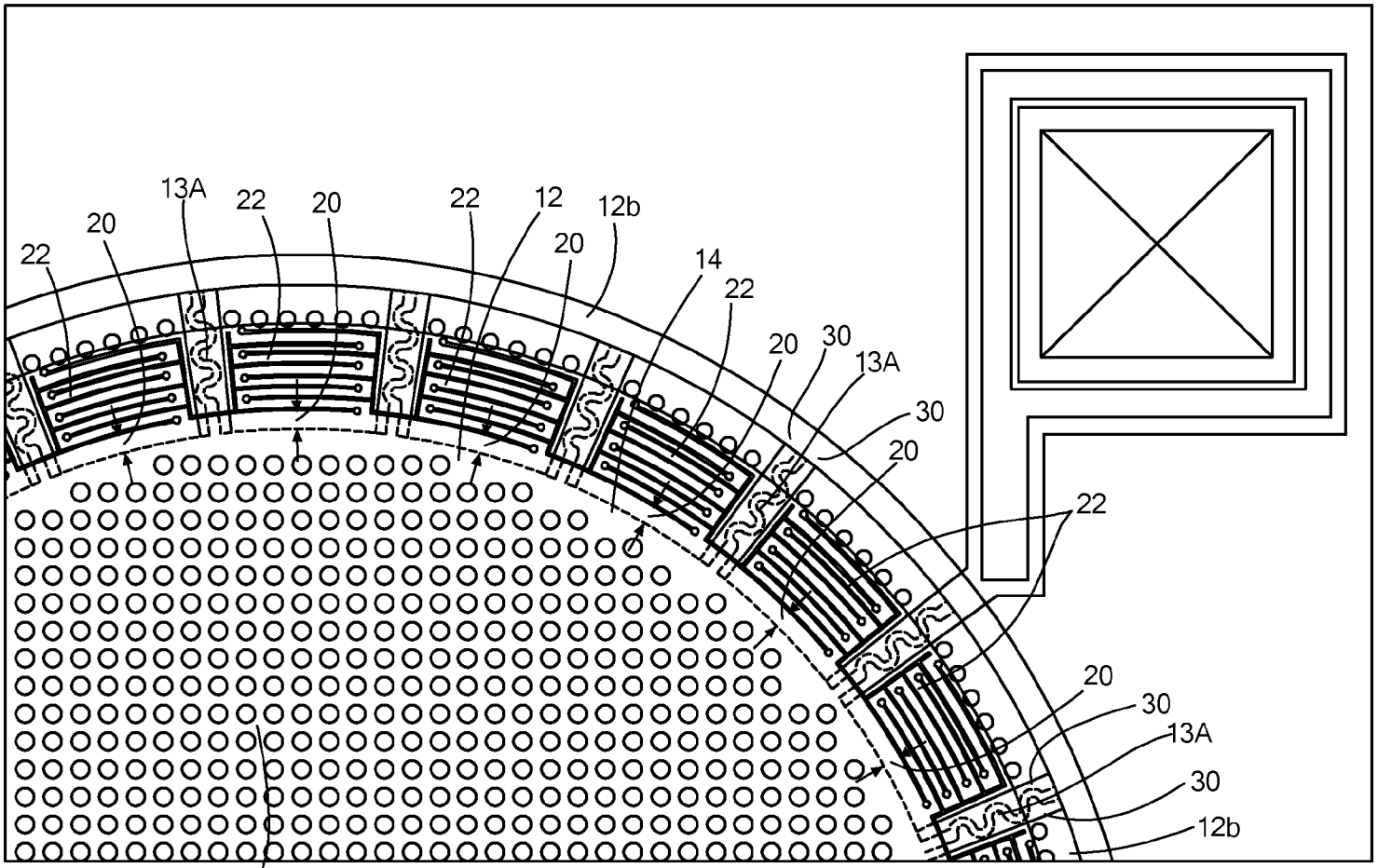
FIG. 4A schematically shows a top view of a portion of the MEMS microphone shown in FIG. 3 with backplate springs configured in accordance with a first embodiment of the invention.
Figure 4B:
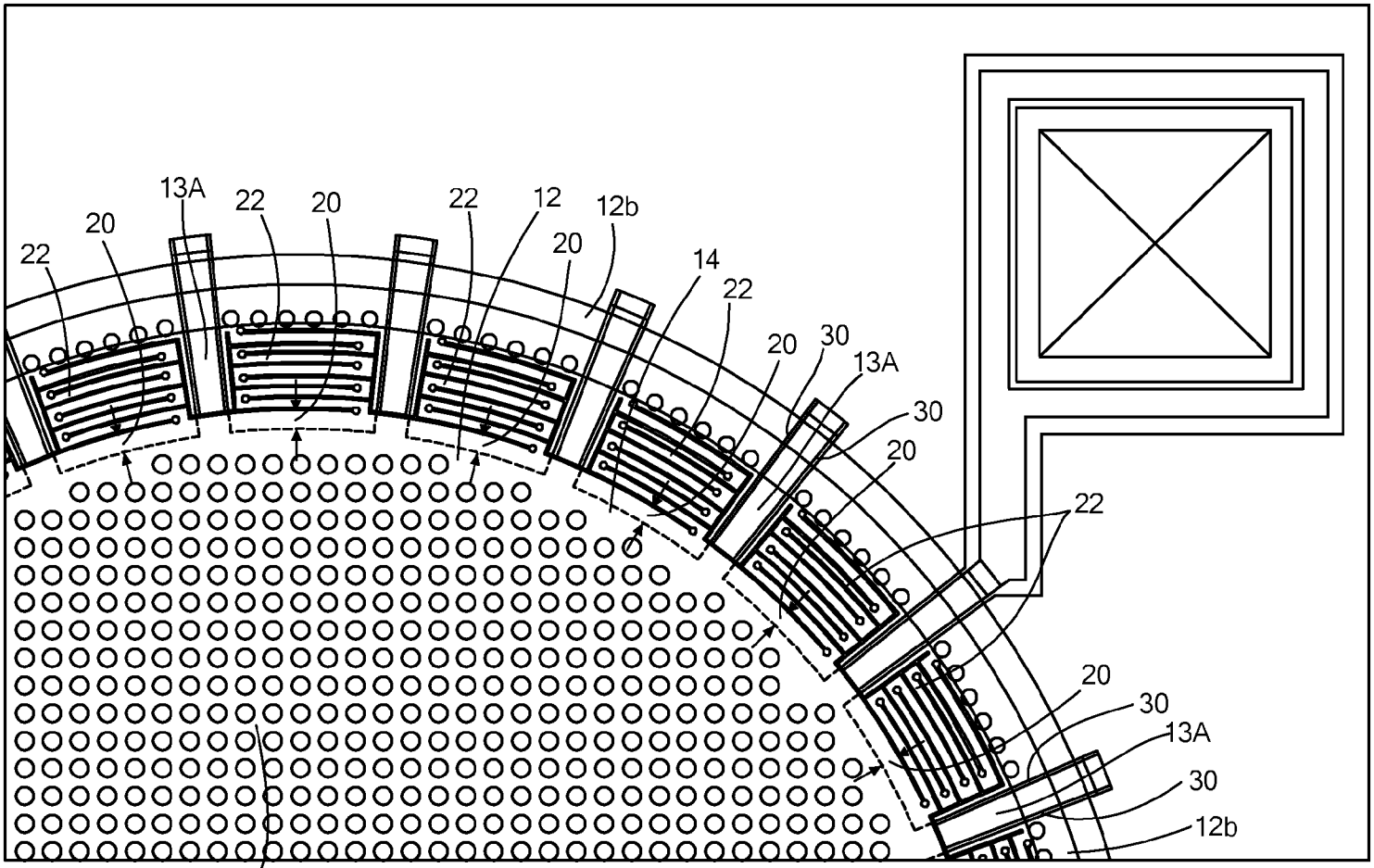
FIG. 4B schematically shows a top view of a portion of the MEMS microphone shown in FIG. 3 with backplate springs configured in accordance with a second embodiment of the invention.

The backplate springs 13A may be configured in any manner sufficient to accomplish the noted function. For example, FIG. 4A shows the springs 13A having a serpentine shape (i.e., having openings), while FIG. 4B shows the springs as substantially solid tethers (i.e., having no openings). In either case, the thickness and shape of the backplate springs 13A are controlled to perform the appropriate function. For example, the tethers 13A of FIG. 4B may be much thinner than the backplate 12.

Figure 6A:
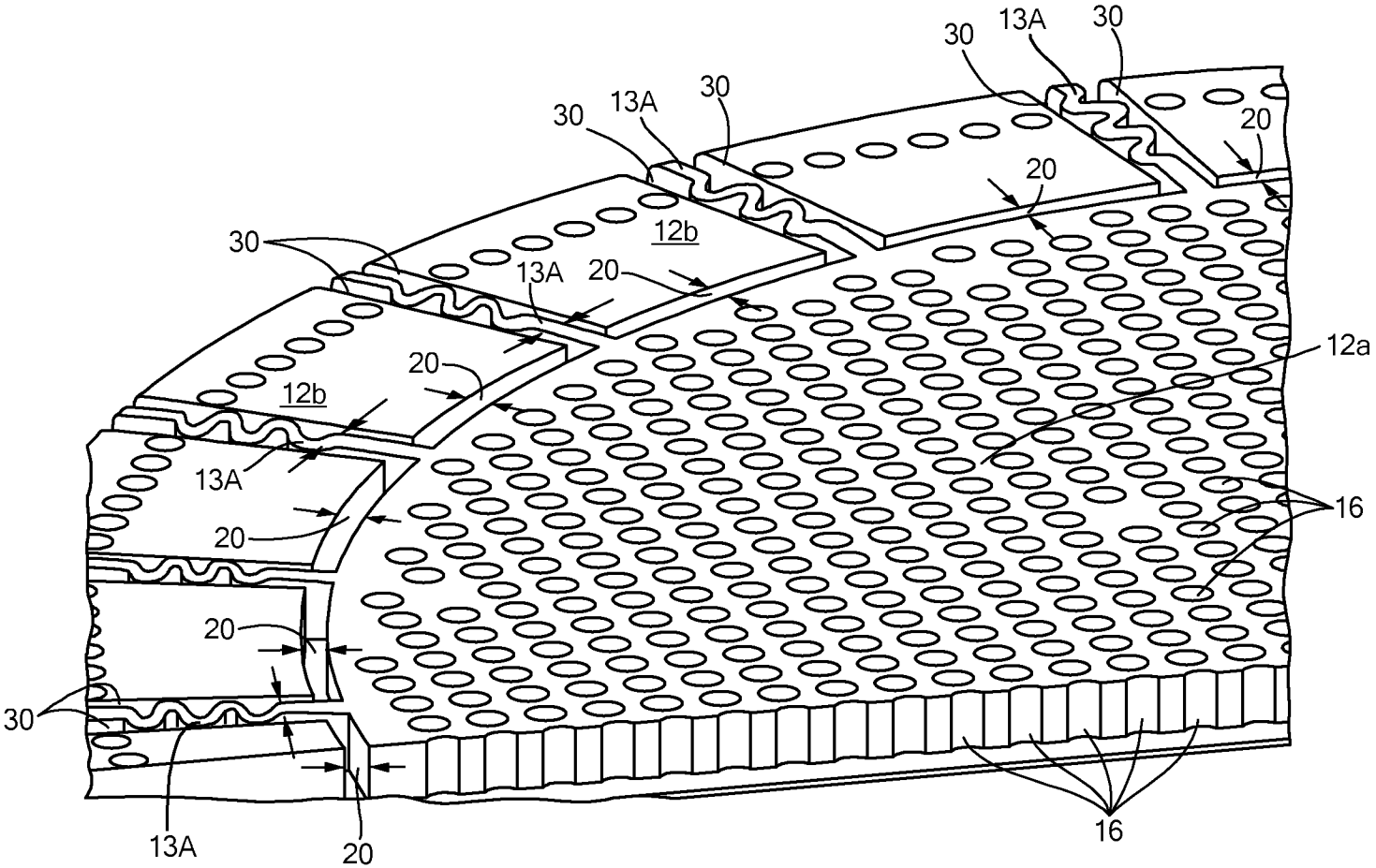
FIG. 6A schematically shows a perspective cross-sectional view of the backplate of FIG. 4A.
Figure 6B:
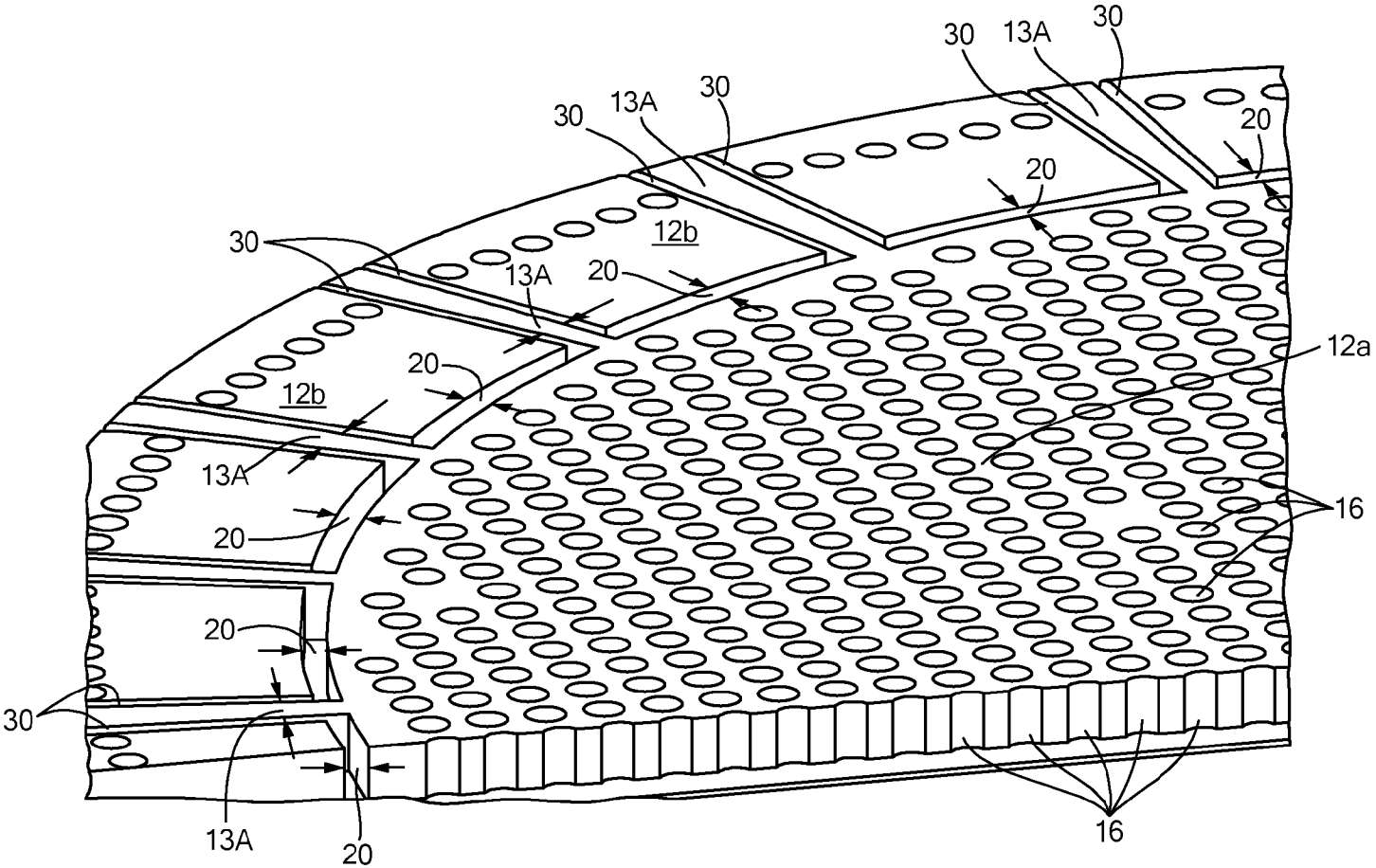
FIG. 6B schematically shows a perspective cross-sectional view of the backplate of FIG. 4B.
Figure 6C:
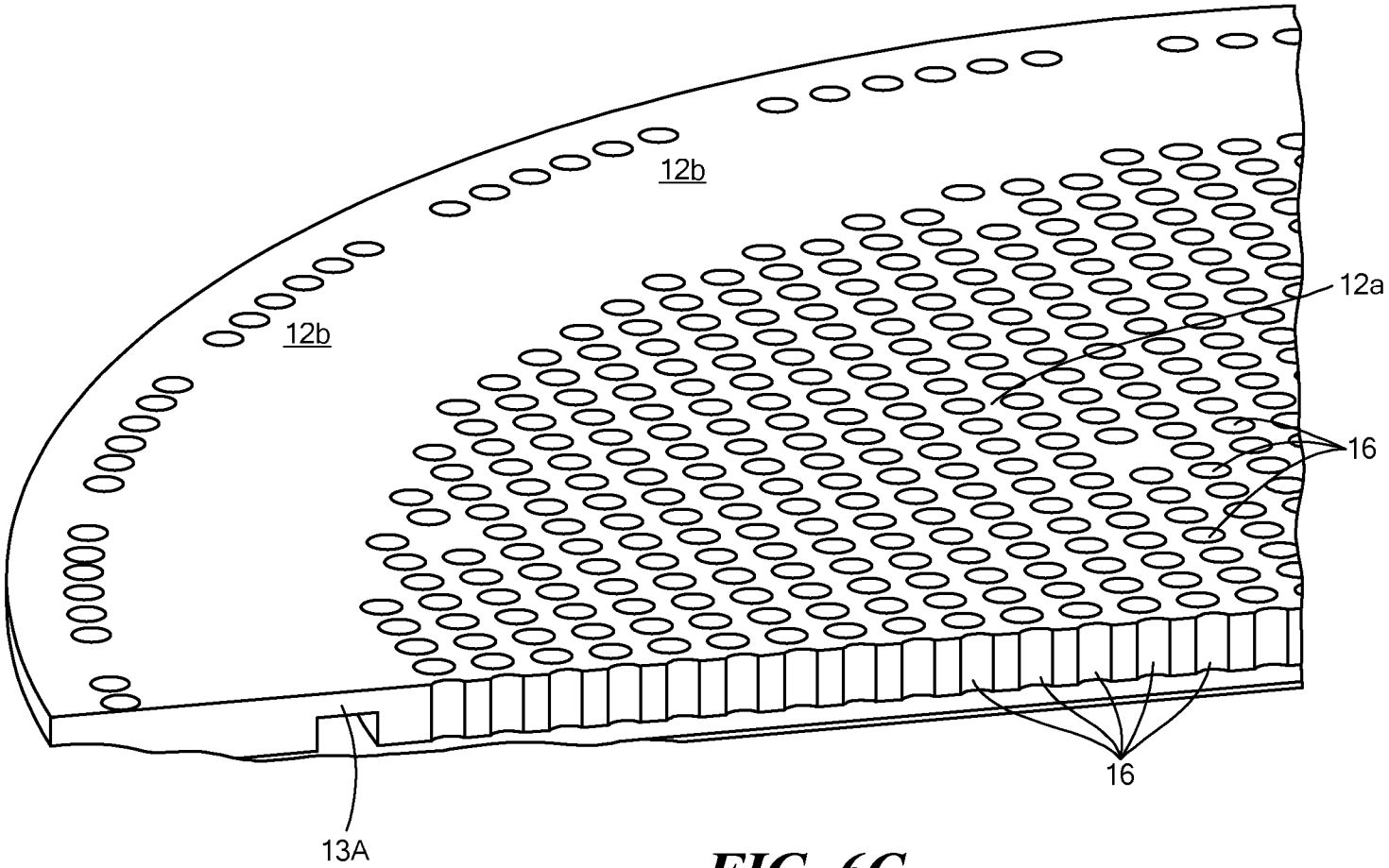
FIG. 6C schematically shows another embodiment of the invention in which the backplate has a solid circumferential spring.

Alternative embodiments (not shown) may have a substantially solid spring 13A circumscribing the entire backplate (like a drum head, as shown in FIG. 6C). In that case, it is anticipated that the portion acting as a backplate spring 13A would be thinner than the backplate 12. For example, the spring 13A can take on the form of an annular groove either in the top surface or bottom surface of the region between the backplate 12 and the base 4. The thickness of this region can vary depending on the desired damping qualities.

As shown, the backplate springs 13A of various embodiments are integral with the backplate 12. In that case, those skilled in the art should readily recognize where the spring 13*a* starts and where the backplate 12 ends. For example, traversing radially outwardly, the spring can be considered to start when the quality of the material changes to be more flexible than the central portion of the backplate 12. This quality can be a change in one or more of thickness, shape, material type, etc. . . . , or when a trench 20 is formed. This is clear in the figures shown, such as those showing serpentine or straight tethered springs 13*a*, or portions having thinner cross-sectional profiles (e.g., tethers that are thinner, or circumferential, continuous drum-like springs 13*a* having thinner cross-sectional profiles than the backplate 12). This general description of a spring should not be confused with portions of the backplate 12 having the through holes 16. Specifically, portions of the backplate 12 having through holes 16 are not springs merely because that overall portion may be more flexible than other portions without through-holes 16.

Preferably, the number of backplate springs 13A coincides with the number of diaphragm springs 22 (discussed in more detail below), although the microphone may have more or fewer backplate springs 13A. The minimum width of each backplate spring 13A (i.e., the distance between adjacent trenches 20) may depend on the number of backplate springs 13A and the intended operating parameters of the microphone 10. The minimum width of each backplate spring 13A should be wide enough to sustain any shock event, such as an overpressure, the microphone 10 may experience. For example, as shown in FIG. 3, if twenty-four backplate springs 13A are used, then, in some embodiments, the minimum width of each backplate spring 13A may be about 5 microns or greater, if intended to be used in standard operating conditions. If the microphone 10 has a smaller number of backplate springs 13A, then the minimum width of each could be increased.

In addition, although not necessary, the microphone 10 also may have trenches or gaps 20 (noted above) that substantially circumscribe a central portion of the backplate 12. The trenches 20 may be partially or substantially filled with air or other dielectric material, e.g., nitride, oxide, or composite layers such as nitride/polysilicon/nitride layers. Although much of this description involves these trenches 20, those in the art should understand that they are optional. Accordingly, various embodiments are not limited to microphones with trenches 20.

Figure 5:
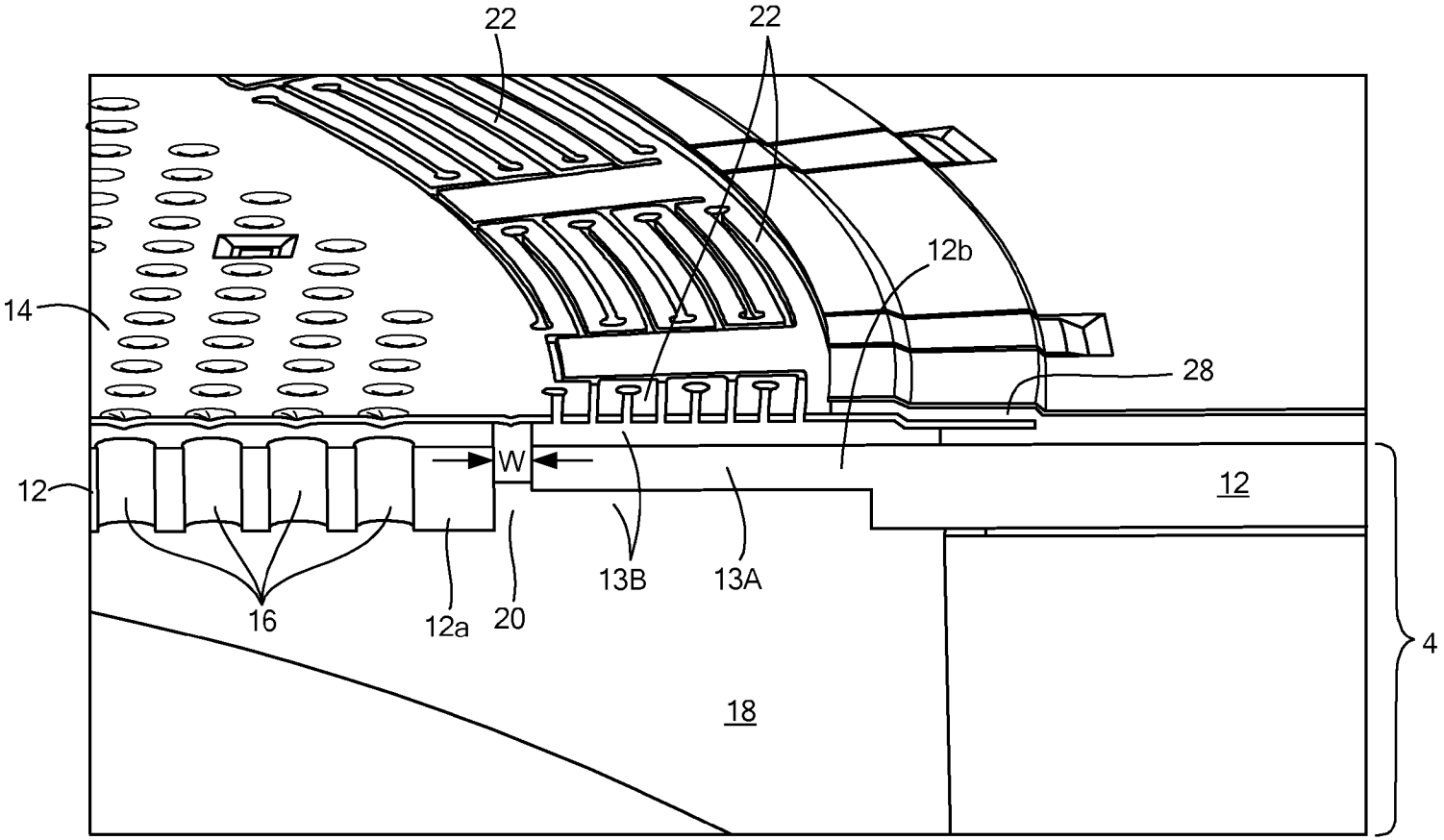
FIG. 5 schematically shows a perspective cross-sectional view of a portion of a MEMS microphone along line A-A of FIG. 3, primarily showing the diaphragm and backplate.

In illustrative embodiments, the trenches 20 in the backplate 12 substantially align with, or are slightly radially inward from, a periphery of the diaphragm 14. FIG. 5 schematically shows a perspective cross-sectional view of a portion of the MEMS microphone 10 along line A-A of FIG. 3, showing the diaphragm 14 and backplate 12 configuration. As shown, the backplate spring 13A is thinner than the backplate 12, and has space 13B above and below it.

FIG. 6A schematically shows a perspective cross-sectional view of a portion of an embodiment of the microphone 10 with serpentine backplate springs 13A shown in FIG. 4A. However, the view is of the underside of the backplate 12 as seen from the backside cavity 18. In a similar manner, FIG. 6B schematically shows a perspective, cross-sectional, underside view of a portion of the microphone 10 of FIG. 4B, which has solid backplate springs 13A.

As shown and noted above, the backplate 12 has a central portion with through-holes 16. The backplate trenches 20 substantially circumscribe the through-holes 16 located in the central portion of the backplate 12. The trenches 20 create an active sensing area 12*a* located radially inward from the trenches 20, and effectively isolate this backplate area 12*a* (e.g., diameter d shown in FIG. 3) from the remaining static backplate 12*b*, which is located radially outward from the trenches 20 (e.g., the portion of the backplate 12*b* surrounding the bond pad 24 shown in FIG. 3, among others). Although a series of trenches 20 are shown, some embodiments use one or more trenches 20. For example, one trench 20 may circumscribe the central portion of the backplate 12 with one tether 13A (described in more detail below) connecting the central portion of the backplate 12 to the remaining portion of the backplate 12*b* and the substrate/SOI wafer 4. The term "backplate" as used herein refers to the portion that forms the substantial majority of the capacitance with the diaphragm 14 (e.g., the active sensing area 12*a* of the embodiment having the trenches 20).

As shown in FIGS. 1 and 3-5 and noted above, the diaphragm 14 has a number of springs 22 formed in an outer portion of the diaphragm 14. The springs 22 movably connect the inner, movable area of the diaphragm 14 to a static/stationary portion 28 of the microphone 10, which includes the base/substrate/SOI wafer 4. The inner, movable area of the diaphragm 14 is located radially inward from the springs 22 (e.g., diameter d' shown in FIG. 3). The springs 22 suspend the diaphragm 14 generally parallel to and above the backplate 12. As shown more clearly in FIG. 5, the springs 22 may have a serpentine shape. In alternative embodiments, the springs 22 may have another shape, such as a solid, tether shape.

To reduce the parasitic capacitance between the backplate 12 and the diaphragm 14, the active backplate area 12*a* is formed to have about the same size and shape as the inner, movable area of the diaphragm 14. For example, a microphone 10 having an inner, movable diaphragm area of about a 500 microns diameter would, preferably, have a backplate area 12*a* diameter (including the area of the apertures 16 in the backplate 12) of about 500 microns. However, due to topological variations during processing, the trenches 20 are preferably formed slightly radially inward from the springs 22 in the periphery of the inner, movable area of the diaphragm 14, such as shown in FIG. 5. For example, the inner wall of the circumferential portion of the trenches 20 should substantially align with the diaphragm area. As another example, the trenches 20 may be formed about 4 to 6 microns radially inward from the springs 22 to ensure that the trench 20 structure does not negatively impact a portion of the spring 22 structure during its fabrication.

Thus, using this example, a microphone 10 having an inner, movable diaphragm area of about a 500 microns diameter would have a backplate area 12*a* diameter of about 488-492 microns, or about 8 to 12 microns less than the diaphragm 14 diameter. Alternatively, the trenches 20 may be formed slightly radially outward from the springs 22. Thus, in this example, a microphone 10 having an inner, movable diaphragm area of about a 500 microns diameter would have a backplate area 12*a* diameter of about 508-512 microns, or about 8 to 12 microns greater than the diaphragm 14 diameter. Although the figures all show and discuss a circular diaphragm 14 and backplate 12 configuration, other shapes may also be used, e.g., oval shapes.

As shown in FIGS. 3, 4A, 4B, 6A and 6B, the microphone 10 may have additional trenches 30 in the backplate 12 alongside the backplate springs 13A. The additional trenches 30 may be formed from each edge of a trench 20 in a radially outward direction relative to the center of the backplate 12. Preferably, the additional trenches 30 are formed and then aligned so that one additional trench 30 is on either side of each spring 22 in the diaphragm 14. Thus, when the diaphragm 14 is aligned on top of the backplate 12 (such as shown in FIGS. 3 and 4), one trench 20 is aligned on the inner side of a spring 22, and two additional trenches 30 are aligned on either side of the spring 22. Since the spring 22 and the backplate 12 also form a variable capacitor, this configuration allows the overall parasitic capacitance of the microphone 10 to be further reduced since the spring 22 area of the diaphragm 14 is effectively eliminated when measuring the backplate 12 to diaphragm 14 variable capacitance. Although the spring 22 and backplate 12 capacitor produces less capacitance change than the diaphragm 14 and backplate 12 capacitor due to the partial deflection of the springs 22, it is nevertheless preferable to exclude the capacitance between the spring 22 and backplate 12 from the total sensing capacitance in order to increase the microphone 10 sensitivity.

Figure 7A:
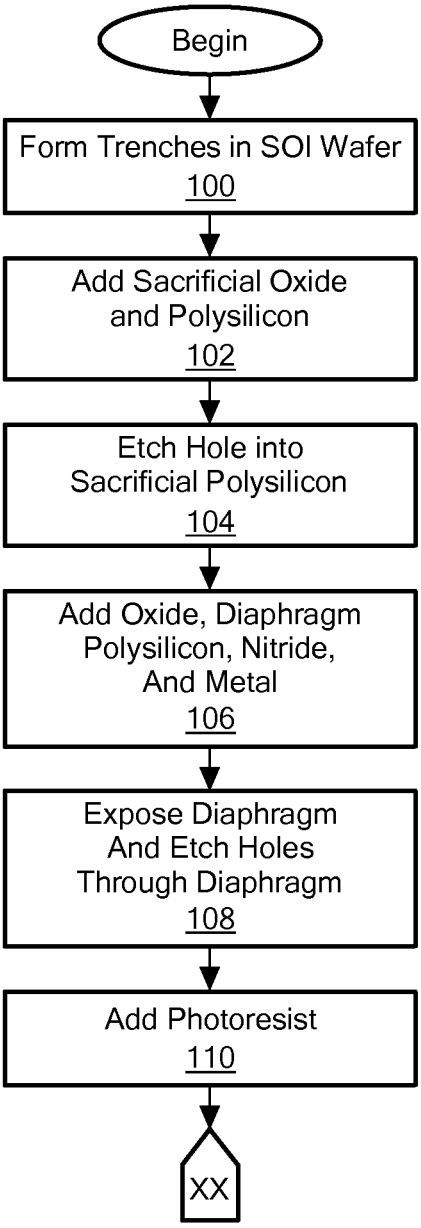
FIGS. 7A and 7B show a process of forming a MEMS microphone, such as shown in FIGS. 1-6B, according to illustrative embodiments of the invention.
Figure 7B:
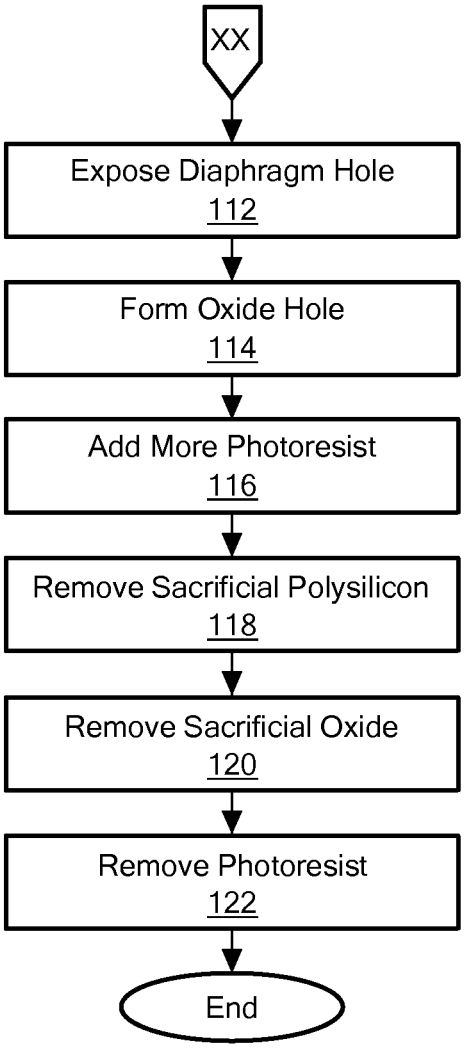

FIGS. 7A and 7B show a process of forming the microphones 10 shown in FIGS. 1-6B in accordance with illustrative embodiments of the invention. The remaining figures (FIGS. 8A-8H) illustrate various steps of this process. Although the following discussion describes various relevant steps of forming a MEMS microphone, it does not describe all the required steps. Other processing steps may also be performed before, during, and/or after the discussed steps. Such steps, if performed, have been omitted for simplicity. The order of the processing steps may also be varied and/or combined. Accordingly, some steps are not described and shown.

The process begins at step 100, which etches trenches 38 in the top layer of a silicon-on-insulator wafer 4. These trenches 38 ultimately form the backplate through-holes 16 and the one or more trenches or gaps 20 in the backplate 12. In addition, this step patterns the top layer to have a plurality of backplate springs 13A as discussed above. For example, in a dissimilar manner to the microphone 10 shown in FIG. 2, the backplate springs 13A shown in FIGS. 8A-8H have a thickness that is about the same as that of the backplate 12.

Figure 8A:
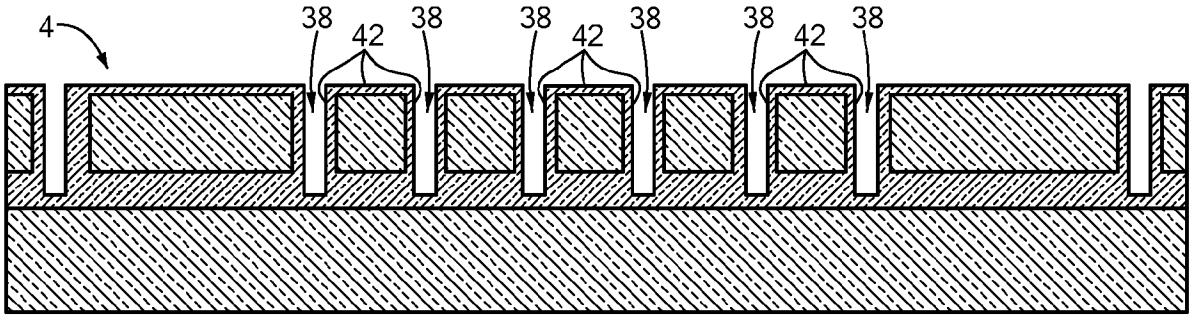
FIGS. 8A-8H schematically show a MEMS microphone, such as shown FIGS. 1-6, during various stages of fabrication using the process of FIGS. 7A and 7B.
Figure 8B:
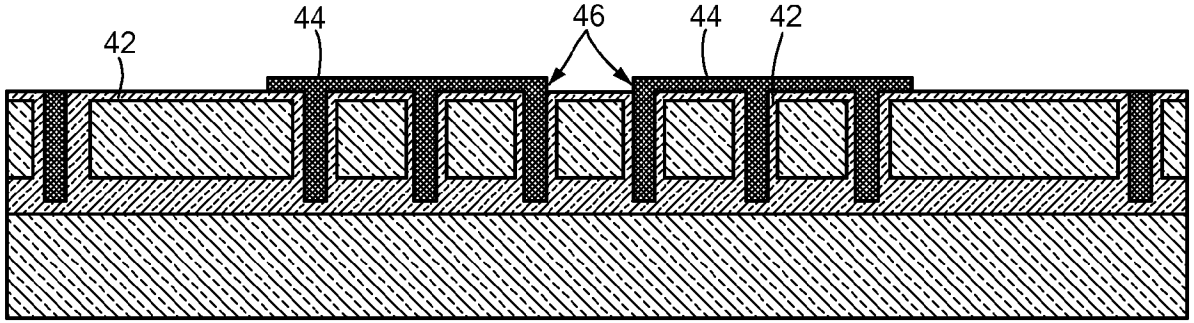
Figure 8C:
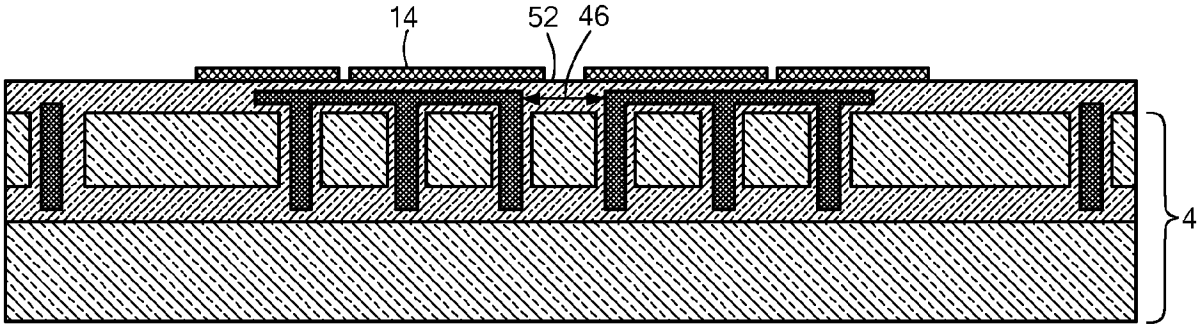

Next, at step 102, the process adds sacrificial oxide 42 to the walls of the trenches 38 and along at least a portion of the top surface of the top layer of the SOI wafer 4. Among other ways, this oxide 42 may be grown or deposited. FIG. 8A schematically shows the wafer at this point in the process. Step 102 continues by adding sacrificial polysilicon 44 to the oxide lined trenches 38 and top-side oxide 42, such as shown in FIG. 8B. Of course, those skilled in the art can process the backplate springs 13A to have other thicknesses, such as thinner than shown in the other figures.

After adding the sacrificial polysilicon 44, the process etches a hole 46 into the sacrificial polysilicon 44 (step 104, see FIG. 8B). The process then continues to step 106, which adds more oxide 42 to substantially encapsulate the sacrificial polysilicon 44. In a manner similar to other steps that add oxide 42, this oxide 42 essentially integrates with other oxides it contacts. Step 106 continues by adding an additional polysilicon layer that ultimately forms the diaphragm 14 (see FIG. 8C). This layer is patterned to substantially align the periphery of the movable, inner diaphragm area with the backplate trenches 20 and the diaphragm springs 22 with the additional trenches 30, in the manner discussed above.

Figure 8D:
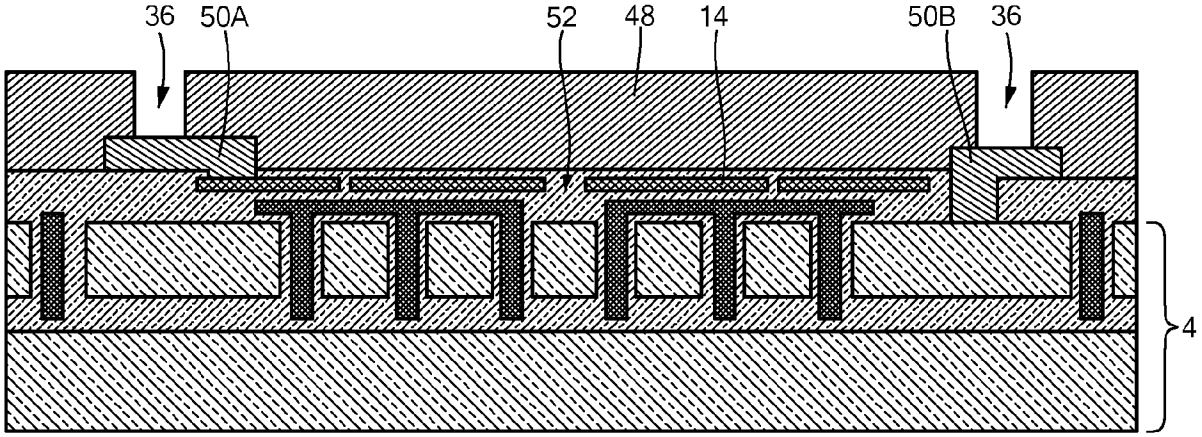

Nitride 48 for passivation and metal for electrical connectivity may also be added (see FIG. 8D). For example, deposited metal may be patterned to form a first electrode 50A for placing electrical charge on the diaphragm 14, another electrode 50B for placing electrical charge on the backplate 12, and contacts 36 for providing additional electrical connections.

Figure 8E:
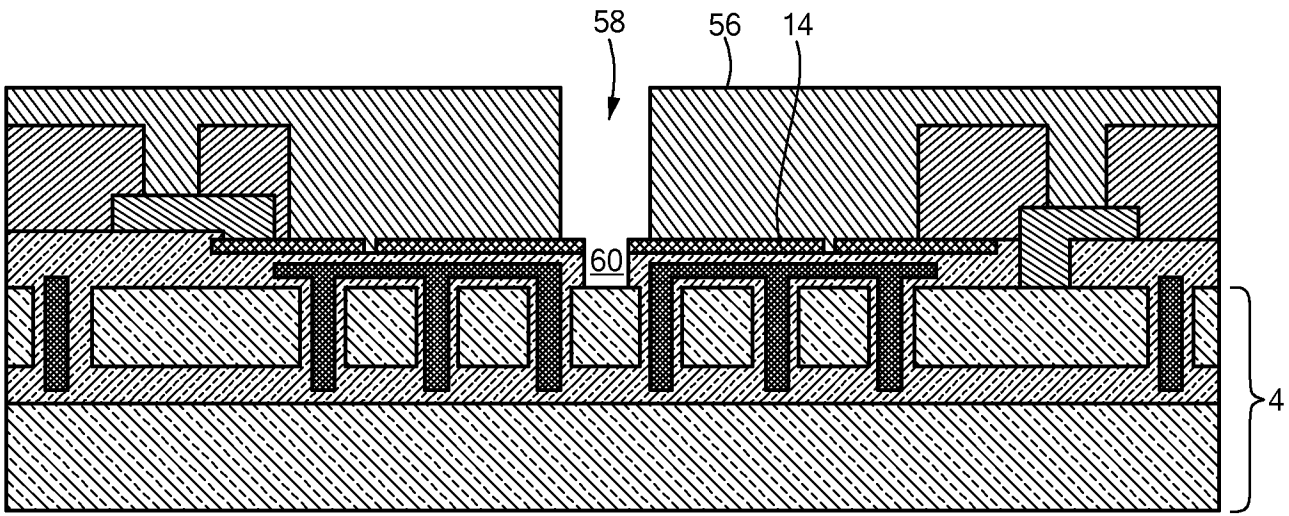

The process then both exposes the diaphragm 14, and etches holes through the diaphragm 14 (step 108). As discussed below in greater detail, one of these holes ("diaphragm hole 52") ultimately assists in forming a pedestal 54 that, for a limited time during this process, supports the diaphragm 14. As shown in FIG. 8E, a photoresist layer 56 then is added, completely covering the diaphragm 14 (step 110). This photoresist layer 56 serves the function of an etch mask.

After adding the photoresist 56, the process exposes the diaphragm hole 52 (step 112). The process forms a hole ("resist hole 58") through the photoresist 56 by exposing that selected portion to light (see FIG. 8E). This resist hole 58 illustratively has a larger inner diameter than that of the diaphragm hole 52.

After forming the resist hole 58, the process forms a hole 60 through the oxide 42 (step 114). In illustrative embodiments, this oxide hole 60 effectively forms an internal channel that extends to the top surface of the SOI wafer 4.

It is expected that the oxide hole 60 initially will have an inner diameter that is substantially equal to the inner diameter of the diaphragm hole 52. A second step, such as an aqueous HF etch, may be used to enlarge the inner diameter of the oxide hole 60 to be greater than the inner diameter of the diaphragm hole 52. This enlarged oxide hole diameter essentially exposes a portion of the bottom side of the diaphragm 14. In other words, at this point in the process, the channel forms an air space between the bottom side of the diaphragm 14 and the top surface of the backplate 12.

Also at this point in the process, the entire photoresist layer 56 may be removed to permit further processing. For example, the process may pattern the diaphragm 14, thus necessitating removal of the existing photoresist layer 56 (i.e., the mask formed by the photoresist layer 56). Other embodiments, however, do not remove this photoresist layer 56 until step 122 (discussed below).

Figure 8F:
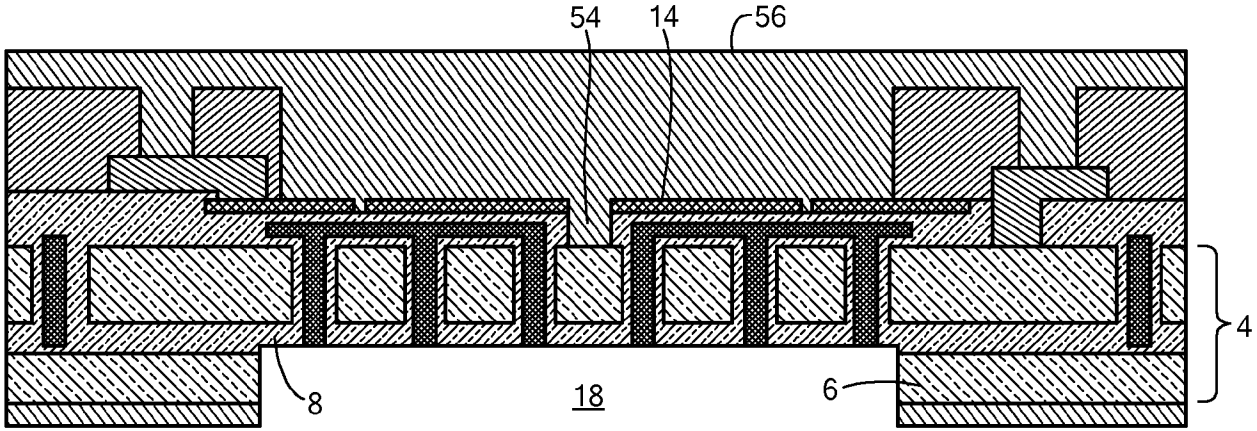
Figure 8G:
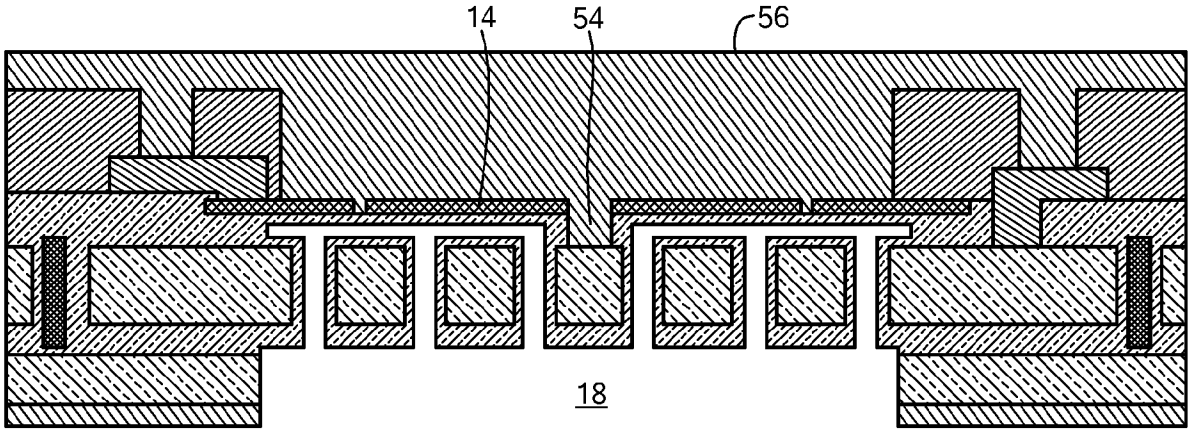

The process then continues to step 116, which adds more photoresist 56, to substantially fill the oxide and diaphragm holes 60, 52 (see FIG. 8F). The photoresist 56 filling the oxide hole 60 contacts the silicon of the top layer of the SOI wafer 4, as well as the underside of the diaphragm 14 around the diaphragm hole 52.

The embodiment that does not remove the original mask thus applies a sufficient amount of photoresist 56 in two steps (i.e., first the mask, then the additional resist to substantially fill the oxide hole 60), while the embodiment that removes the original mask applies a sufficient amount of photoresist 56 in a single step. In both embodiments, as shown in FIG. 8F, the photoresist 56 essentially acts as a single, substantially contiguous material above and below the diaphragm 14. Neither embodiment patterns the photoresist 56 before the sacrificial layer is etched (i.e., removal of the sacrificial oxide 42 and polysilicon 44, discussed below).

In addition, the process may form the backside cavity 18 at this time, such as shown in FIG. 8F. Conventional processes may apply another photoresist mask on the bottom side of the SOI wafer 4 to etch away a portion of the bottom SOI silicon layer 6. This should expose a portion of the oxide layer 8 within the SOI wafer 4. A portion of the exposed oxide layer 8 then is removed to expose the remainder of the sacrificial materials, including the sacrificial polysilicon 44.

At this point, the sacrificial materials may be removed. The process removes the sacrificial polysilicon 44 (step 118, see FIG. 8G) and then the sacrificial oxide 42 (step 120, FIG. 8H). Among other ways, illustrative embodiments remove the polysilicon 44 with a dry etch process (e.g., using xenon difluoride) through the backside cavity 18. In addition, illustrative embodiments remove the oxide 42 with a wet etch process (e.g., by placing the apparatus in an acid bath for a predetermined amount of time). Some embodiments, however, do not remove all of the sacrificial material. For example, such embodiments may not remove portions of the oxide 42. In that case, the oxide 42 may impact capacitance.

Figure 8H:
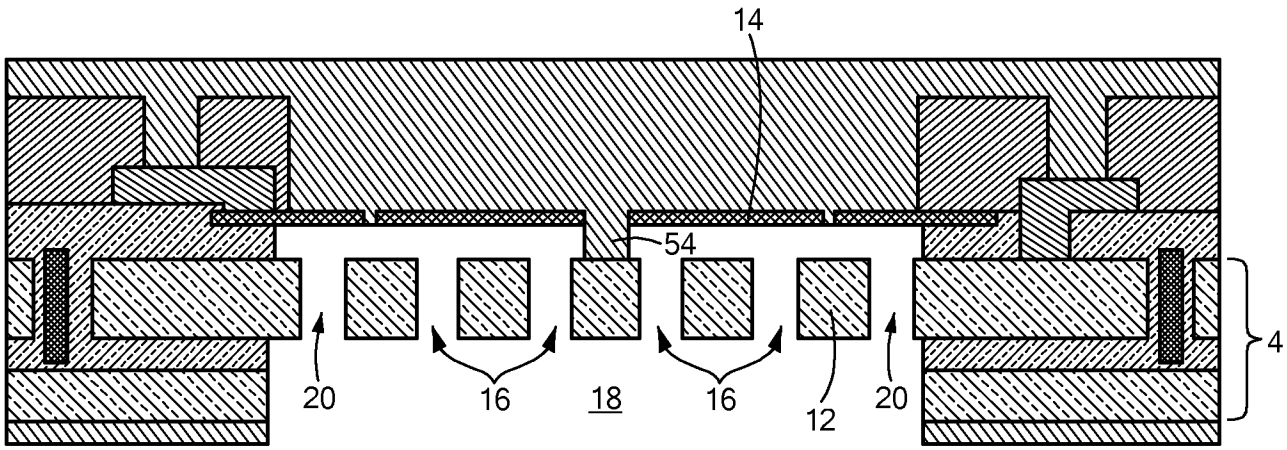

As shown in FIG. 8H, the photoresist 56 between the diaphragm 14 and top SOI layer supports the diaphragm 14. In other words, the photoresist 56 at that location forms a pedestal 54 that supports the diaphragm 22. As known by those skilled in the art, the photoresist 56 is substantially resistant to wet etch processes (e.g., aqueous HF process, such as those discussed above). It nevertheless should be noted that other wet etch resistant materials may be used. Discussion of photoresist 56 thus is illustrative and not intended to limit the scope of all embodiments.

Stated another way, a portion of the photoresist 56 is within the prior noted air space between the diaphragm 14 and the backplate 12; namely, it interrupts or otherwise forms a part of the boundary of the air space. In addition, as shown in the figures, this photoresist 56 extends as a substantially contiguous apparatus through the hole 52 in the diaphragm 14 and on the top surface of the diaphragm 14. It is not patterned before removing at least a portion of the sacrificial layers. No patterning steps are required to effectively fabricate the microphone 10.

To release the diaphragm 14, the process continues to step 122, which removes the photoresist 56/pedestal 54 in a single step, such as shown in FIG. 2. Among other ways, dry etch processes through the backside cavity 18 may be used to accomplish this step. This step illustratively removes substantially all of the photoresist 56—not simply selected portions of the photoresist 56.

It should be noted that a plurality of pedestals 54 may be used to minimize the risk of stiction between the backplate 12 and the diaphragm 14. The number of pedestals used is a function of a number of factors, including the type of wet etch resistant material used, the size and shape of the pedestals 54, and the size, shape, and composition of the diaphragm 14. Discussion of a single pedestal 54 therefore is for illustrative purposes.

The process may then completes fabrication of the microphone 10. Specifically, among other things, the microphone 10 may be tested, packaged, or further processed by conventional micromachining techniques. To improve fabrication efficiency, illustrative embodiments of the invention use batch processing techniques to form the MEMS microphone 10. Specifically, rather than forming only a single microphone, illustrative embodiments simultaneously form a two dimensional array of microphones on a single wafer. Accordingly, discussion of this process with a single MEMS microphone is intended to simplify the discussion only and thus, not intended to limit embodiments to fabricating only a single MEMS microphone 10.

Accordingly, illustrative embodiments suspend the backplate 12 with relatively large springs 13*a* to reduced intrinsic stresses that can create an undesirable curvature in the backplate 12 during processing, assembly, and packaging. If not mitigated, this stress can reduce the sensitivity of the microphone. Although suspended, the backplate still should remain substantially immovable relative to the base, thus ensuring appropriate sensitivity and appropriate signal to noise levels. As noted, suspending the backplate 12 in this manner runs counter to conventional wisdom, which teaches maintaining the backplate 12 as stationary as possible during use.

Although the above discussion discloses various exemplary embodiments of the invention, it should be apparent that those skilled in the art can make various modifications that will achieve some of the advantages of the invention without departing from the true scope of the invention.

What is claimed is:

1. A MEMS microphone comprising:

a base;

a diaphragm supported by diaphragm springs;

a backplate having a static backplate, springs and trenches, the trenches configured to create an active sensing area located radially inward from the trenches, the trenches effectively isolating the active sensing area from the static backplate and the backplate springs, the backplate springs configured to support the backplate on the base;

a diaphragm having diaphragm springs, wherein the backplate springs are fabricated so that the backplate remains substantially unaffected upon receipt of an anticipated incident audio signal of normal intensity, where a spring constant of the backplate springs is substantially greater than a spring constant of the diaphragm springs or a collective spring constant of the backplate springs is greater than a collective spring constant of the diaphragm springs.

2. The MEMS microphone of claim 1, wherein the backplate springs are substantially solid circumscribing an entirety of the backplate.

3. The MEMS microphone of claim 1, wherein a portion of the backplate springs is thinner than the backplate.

4. The MEMS microphone of claim 1, wherein the backplate springs is in to the form of an annular groove either in a top surface or bottom surface of a region between the backplate and the base.

5. The MEMS microphone of claim 4, wherein a thickness of the region varies depending on a desired damping quality.

6. The MEMS microphone of claim 1, wherein the backplate springs are integral with the backplate.

7. The MEMS microphone of claim 6, wherein backplate springs traverse radially outwardly starting with when a quality of materials thereof changes to be more flexible than a central portion of the backplate, the quality of materials being a change in one or more of a thickness, shape, material type or when trenches are formed.

8. The MEMS microphone of claim 1, wherein a number of the backplate springs coincides with a number of the diaphragm springs.

9. The MEMS microphone of claim 1, wherein a minimum width of each of the backplate springs is based on a number of the backplate springs.

10. The MEMS microphone of claim 1, wherein the backplate further has a central portion with through-holes and wherein the trenches substantially circumscribe the backplate through-holes.

11. The MEMS microphone of claim 1, wherein the static backplate is located radially outward from the trenches.

12. The MEMS microphone of claim 1, further including a bond pad, wherein the static backplate is a portion of the backplate that surrounds the bond pad.

13. The MEMS microphone of claim 1, wherein the backplate includes additional trenches alongside the backplate springs, the additional trenches formed from each edge of one of the trenches in a radially outward direction relative to a center of the backplate.

14. The MEMS microphone of claim 13, wherein the additional trenches are aligned so that each of the additional trenches is positioned on either side of each of the diaphragm springs such that when the diaphragm is aligned on top of the backplate, one of the trenches is aligned on an inner side of the diaphragm springs and two of the additional trenches are aligned on either side of the diaphragm springs.

* * * * *